US011072444B2

(12) United States Patent
Holka et al.

(10) Patent No.: US 11,072,444 B2
(45) Date of Patent: Jul. 27, 2021

(54) METHOD OF PRODUCING AND FILLING A PACKAGING CONTAINER

(71) Applicant: AR Packaging Systems AB, Lund (SE)

(72) Inventors: Simon Holka, Staffanstorp (SE); Lennart Larsson, Malmö (SE); Henrik Herlin, Kristianstad (SE); Maria Siöland, Kristianstad (SE)

(73) Assignee: AR Packaging Systems AB

( * ) Notice: Subject to any disclaimer, the term of this patent is extended or adjusted under 35 U.S.C. 154(b) by 310 days.

(21) Appl. No.: 16/315,383

(22) PCT Filed: Jul. 4, 2017

(86) PCT No.: PCT/SE2017/050743
§ 371 (c)(1),
(2) Date: Jan. 4, 2019

(87) PCT Pub. No.: WO2018/009128
PCT Pub. Date: Jan. 11, 2018

(65) Prior Publication Data

US 2019/0256230 A1 Aug. 22, 2019

(30) Foreign Application Priority Data

Jul. 6, 2016 (SE) ..... 1650996-0

(51) Int. Cl.
*B65B 1/02* (2006.01)
*B65B 1/06* (2006.01)
(Continued)

(52) U.S. Cl.
CPC ..... *B65B 1/02* (2013.01); *B31B 50/81* (2017.08); *B65B 1/06* (2013.01); *B65B 7/2878* (2013.01);
(Continued)

(58) Field of Classification Search
CPC ..... B65B 7/2842; B65B 7/285; B65B 7/2871; B65B 7/2878; B65B 51/144;
(Continued)

(56) References Cited

U.S. PATENT DOCUMENTS 4,287,703 A * 9/1981 Henle ..... B65B 43/54 53/449
5,566,529 A * 10/1996 Sireix ..... B65D 3/262 53/412
(Continued)

FOREIGN PATENT DOCUMENTS

CA 2921554 A1 2/2015
CN 101626955 A 1/2010
(Continued)

OTHER PUBLICATIONS

Stiffness—Wikipedia.org, retrieved from URL https://en.wikipedia.org/wiki/Stiffness on Dec. 30, 2020 (Year: 2020).*
(Continued)

*Primary Examiner* — Valentin Neacsu
(74) *Attorney, Agent, or Firm* — Lerner, David, Littenberg, Krumholz & Mentlik, LLP

(57) ABSTRACT

A method of producing and filling a paperboard packaging container with bulk solids material comprising forming a tubular container body, closing an upper body opening of the tubular container body, filling bulk solids into the container body a bottom body opening of the tubular containing body, closing the bottom body opening, and turning container body such that an upper end is directed upwards in a vertical direction, thereby allowing improved control of the pressure within the packaging container.

14 Claims, 4 Drawing Sheets

(51) Int. Cl.

| | |
|---|---|
| ***B65B 7/28*** | (2006.01) |
| ***B65B 43/10*** | (2006.01) |
| ***B65B 51/10*** | (2006.01) |
| ***B65D 43/16*** | (2006.01) |
| ***B65D 51/20*** | (2006.01) |
| ***B65B 31/00*** | (2006.01) |
| ***B31B 50/81*** | (2017.01) |
| *B65B 51/22* | (2006.01) |
| *B31B 50/64* | (2017.01) |
| *B31B 50/26* | (2017.01) |
| *B31B 120/10* | (2017.01) |
| *B31B 110/20* | (2017.01) |
| *B31B 50/62* | (2017.01) |

(52) U.S. Cl.

CPC ..... *B65B 31/00* (2013.01); *B65B 43/10* (2013.01); *B65B 51/10* (2013.01); *B65D 43/163* (2013.01); *B65D 43/164* (2013.01); *B65D 51/20* (2013.01); *B31B 50/26* (2017.08); *B31B 50/62* (2017.08); *B31B 50/64* (2017.08); *B31B 2110/20* (2017.08); *B31B 2120/10* (2017.08); *B65B 51/22* (2013.01); *B65D 2251/0018* (2013.01); *B65D 2251/0021* (2013.01); *B65D 2251/0093* (2013.01); *B65D 2251/1016* (2013.01)

(58) Field of Classification Search

CPC ... B31B 50/0045; B31B 50/81; B31B 50/814; B31B 50/64; B31B 50/644; B65D 3/04; B65D 3/12; B65D 3/14; B65D 2251/00–0096

USPC ..... 53/456, 281, 471, 266.1, 242, 243, 484, 53/485, 487, 489, 449, 478, 477; 493/114, 115

See application file for complete search history.

(56) References Cited

U.S. PATENT DOCUMENTS 6,722,104 B1 * 4/2004 Haggman ..... B65B 3/027 53/412
9,546,009 B2 * 1/2017 Hagelqvist ..... B65B 31/028
2002/0014520 A1 * 2/2002 Haggman ..... B65B 3/027 229/4.5
2006/0021298 A1 * 2/2006 Van Caeneghem ..... B31B 50/00 53/452
2008/0245685 A1 10/2008 Messing et al.
2012/0241510 A1 * 9/2012 Clougherty ..... B65D 3/04 229/120
2014/0215973 A1 * 8/2014 Hagelqvist ..... B65B 7/2878 53/478
2014/0287901 A1 * 9/2014 Hagelqvist ..... B31B 70/74 493/108
2015/0329267 A1 * 11/2015 Holka ..... B65D 25/54 356/437
2017/0043928 A1 2/2017 Piao
2019/0177055 A1 * 6/2019 Herlin ..... B65D 51/247

FOREIGN PATENT DOCUMENTS

| | | | | |
|---|---|---|---|---|
| CN | 104016019 | A | 9/2014 | |
| EP | 0611703 | B1 | 5/1997 | |
| EP | 1021337 | B1 | 12/2002 | |
| NL | 1004001 | C2 | 3/1998 | |
| WO | 8703536 | A1 | 6/1987 | |
| WO | 9810988 | A1 | 3/1998 | |
| WO | 2013057392 | A1 | 4/2013 | |
| WO | WO-2013057392 | A1 * | 4/2013 | ..... B65D 15/08 |
| WO | 2016126193 | A1 | 8/2016 | |

OTHER PUBLICATIONS

Swedish Standard ISO 2493, version published Dec. 2010, retrieved online from URL https://www.sis.se/api/document/preview/75930/ (Year: 2010).*

Definition of "Pulverulent" by Merriam-Webster, retrieved from URL https://www.merriam-webster.com/dictionary/pulverulent on Jan. 5, 2021 (Year: 2021).*

Definition of "Emboss" by Merriam-Webster retrieved from URL https://www.merriam-webster.com/dictionary/emboss on Jan. 5, 2021 (Year: 2021).*

Chinese Search Report for Appllication No. 201780042209.6 dated Jun. 30, 2020, 1 page.

International Search Report for PCT/SE2017/050743 dated Sep. 29, 2017.

* cited by examiner

METHOD OF PRODUCING AND FILLING A PACKAGING CONTAINER

CROSS-REFERENCE TO RELATED APPLICATIONS

The present application is a national phase entry under 35 U.S.C. § 371 of International Application No. PCT/SE2017/050743, filed on Jul. 4, 2017, published in English, which claims priority from Swedish Application No. 1650996-0 filed Jul. 6, 2016, the disclosures of which are incorporated herein by reference.

TECHNICAL FIELD

The present disclosure pertains to a method of producing and filling a paperboard packaging container with bulk solids.

BACKGROUND

When packaging of consumer goods, and in particular when packaging bulk solids it is common to use rigid paperboard packaging containers which serve as protective transport and storage containers at the retail end and as storage and dispensing containers at the consumer end. During transport and storage paperboard packaging containers are conventionally provided in secondary packages, in which a plurality paperboard packaging containers may be stacked and/or placed side-by-side.

Paperboard containers intended for bulk solids are usually provided with an openable and closable lid, and with an inner removable or breakable barrier membrane which keeps the contents fresh and protected against contamination up until delivery of the packaging container to a consumer.

The bulk solids may be filled into paperboard packing containers either from the packaging container top or from the packaging container bottom. The present disclosure relates a method of producing and filling a paperboard packaging container from the bottom. During such type of production of packaging containers, the internal pressure obtained within the packaging containers may vary considerably. This is due to the fact that the bottom disc is pressed into and seals the packaging container after the packaging top has been sealed with a barrier membrane and is air tight. As the bottom disc conventionally is a rigid and inflexible disc, an internal pressure within some of the packaging container may be the result of this bottom disc sealing. This may lead to irregularly sized packages which may be difficult to pack in a secondary package. For such packaging systems it may thus be desirable to improve the control of the pressure within the packaging container.

SUMMARY

One object of the present invention is to provide a method of producing and filling a paperboard packaging container from the packaging bottom allowing to improve the control of the pressure within the packaging container.

This and other objects of the present disclosure may be achieved by a method of producing and filling a paperboard packaging container according to the appended claims.

As such, the method of producing and filling a paperboard packaging container with bulk solids as disclosed herein comprises the steps of:

a) forming a tubular container body from a paperboard sheet, the container body having an upper end with an upper body opening and a bottom end with a bottom body opening and a container body wall extending in a height direction of the packaging container between the upper body opening and the bottom body opening, the container body wall having an inner surface and an outer surface;

b) closing the upper body opening with an inner peelable or openable transport closure by attaching the inner transport closure to the inner surface of the container body wall;

c) presenting the container body to a filling station with the bottom body opening of the container body directed upward in a vertical direction;

d) filling bulk solids into the container body through the upwardly directed bottom body opening;

e) presenting the container body to a bottom body opening sealing station comprising at least one guiding member forming an, as seen from the bottom end, upwardly extending guiding channel;

f) closing the bottom body opening by pressing a bottom disc through the guiding channel and into the bottom body opening such that a pressure above the ambient pressure is produced within the packaging container, the bottom disc having a peripheral flange surrounding a bottom disc base portion, the peripheral flange being flexed towards the upper end in the height direction (H) and wherein the guiding channel extends away from the container body, in the height direction (H), with a length ($L_1$), as measured from the bottom end edge. The bottom disc is pressed into the bottom body opening with a length ($L_2$) in the height direction, as measured between the bottom end edge and the bottom disc base portion and wherein the sum of $L_1$ and $L_2$ is 25 mm or more;

g) attaching the bottom disc to the inner surface of the container body wall by welding, wherein step f) is performed immediately after step e) while maintaining a pressure above the ambient pressure within said packaging container; and h) turning the container body such that the upper end is directed upwards in the vertical direction and the bottom end is directed downwards in the vertical direction, such that the bulk solids are compressed against the bottom disc under the combined influence of gravity and internal pressure in the container.

The fact that the bottom disc is pressed through the guiding channel, into the bottom body opening and through the bottom end of the container body with a total distance, being the sum of $L_1$ and $L_2$, of 25 mm or more gives a controlled and somewhat higher than the ambient pressure within the inner compartment. A controlled and somewhat higher pressure than the ambient pressure within the inner compartment in a closed packaging container has been found to be advantageous as it aids in ensuring a uniform pressure level within the inner compartment between different packaging containers produced in the same production line. The fact that the inner compartments of all packaging containers produced in the same run have a uniform inner pressure gives the advantage of uniformly shaped packages which are easier to arrange in uniform stacks and to provide with a secondary package.

By "ambient pressure" is meant the pressure surrounding the packaging container and which comes in contact with the packaging container.

Optionally, the bulk solids may be in the form of a pulverulent material.

A further advantage linked to providing the packaging container according to the present disclosure with means to ensure a controlled pressure above the ambient pressure has surprisingly been found to be an improved security for keeping contents in the packaging container fresh. Without wishing to be bound by theory, this is believed to be an effect of the elevated pressure in the packaging container causing the bulk solids in the packaging container to be compressed against the bottom disc. When compressing the bulk solids in the form of pulverulent material against the bottom disc and against the seal formed between the bottom disc and the inner surface of the container wall, this provides an increased overall protection of the pulverulent material in the package against possible leakages of air and/or moisture as the compressed pulverulent material forms an additional barrier at the seal between the flange of the bottom disc and the inner surface of the container wall. Furthermore, the compressed, closely packed material in itself reduces air diffusion into the contents which means that the packaged contents below the exposed upper surface may remain protected against oxidation even after opening the packaging container by removal of the transport closure.

Optionally, the sum of $L_1$ and $L_2$ is between 25 mm and 260 mm. $L_2$ may be at least 5 mm. $L_1$ may be at least 20 mm.

Optionally, the sum of $L_1$ and $L_2$ is between 50 mm and 100 mm. $L_2$ may be at least 5 mm. $L_1$ may be at least 45 mm.

Optionally, the guiding member(s) in step f) encloses 80% or more of the circumference of said the body, or 95% or more of the circumference of the container body.

The fact that the guiding member(s) in step f) encloses 80% or more of the circumference of said the body, or 95% or more of the circumference of the container body allows for a slight but not too high overpressure to be created within the inner compartment of the packaging container.

Optionally, the guiding member is in the form of a closed guiding channel, enclosing the circumference of said container body entirely.

The fact that the guiding channel is in the form of a closed guiding channel increases the control of the resulting internal pressure level as the speed with which the bottom disc is pushed through the guiding channel becomes less important with a closed guiding channel.

Optionally, the guiding channel is a combined guiding channel and welding means for performing step h).

The provision of a combined guiding channel and welding ensures that the bottom disc is attached immediately to the inner surface of the container body wall by welding, and that a pressure above the ambient pressure is maintained and ensured within said packaging container.

Optionally, step g) comprises that a size ratio of the bottom disc surface area to the bottom body opening surface area is at least 1.01, such that an outer edge portion of the bottom disc is shaped and flexed when the bottom disc is pressed into the body bottom opening, the outer edge portion of the bottom disc forming a flange projecting out of a main plane of said bottom disc, the flange being aligned with the inner surface of the container body wall.

The fact that the flange is flexed and shaped by pressing the bottom disc into the body bottom opening ensures that the outer edge portion of the bottom disc is pressed tightly against the inner surface of the container wall and conformed exactly to the shape of the container body bottom opening. This may improve the provision of a uniform pressure level within the inner compartment between different packaging containers produced in the same production line.

Optionally, the size ratio of the bottom disc surface area to the bottom body opening surface area is from 1.01 to 1.3.

The fact that the size ratio of the bottom disc surface area to the bottom body opening surface area is from 1.01 to 1.3 ensures a sufficiently large flange to form and thereby provide an sufficiently large area to form a suitable attachment by welding for the intended purpose of resisting to the slight pressure above the ambient pressure within the packaging container.

Optionally, the bottom disc is pressed into said bottom body opening with a speed of at least 30 mm/s and not more than 150 mm/s. This controlled speed provides for a slight, but controlled, internal pressure above the ambient pressure within the packaging container.

Optionally, the bottom disc comprises a material having a stiffness of from 100 mN to 1500 mN, as measured according to the Swedish standard 55-ISO 2493-1:2010, and comprises folding lines corresponding to the size and shape of the body bottom opening to enable folding of the outer edge portion of the bottom disc when the bottom disc is pressed into the bottom body opening.

Optionally, the bottom disc comprises reinforcing elements. Such elements may be in the form of embossed continuous or discontinuous lines or elements, the lines may be straight lines or curved lines.

The fact that the bottom disc comprises a material having a stiffness of from 100 mN to 1500 mN or is provided with reinforcing elements provides stability to the bottom disc during application of the bottom disc into the bottom end as there will be a certain pressure against the bottom disc provided by the compressed air which may risk deflection of the bottom disc, and thus ensures the provision of a certain pressure above the ambient pressure within the inner compartment of the packaging container.

As used herein, a paperboard sheet material is a material predominantly made from cellulose fibers or paper fibers. The sheet material may be provided in the form of a continuous web or may be provided as individual sheets of material. The paperboard material may be a single ply or multi ply material and may be a laminate comprising one or more layers of materials such as polymeric films and coatings, metal foil, etc. The polymeric films and coatings may include or consist of thermoplastic polymers. The paperboard materials as disclosed herein may also be referred to as cardboard or carton materials.

As used herein, the term "bulk solids" refers to a solid material. The bulk material may be dry or moist. The bulk solids may be in the form of particles, granules, grinds, plant fragments, short fibres, flakes, seeds, formed pieces of material such as pasta, etc. The bulk solids which are suitable for packaging in the packaging containers as disclosed herein may be flowable, which means that a desired amount of the product may be poured or scooped out of the packaging container, or in the form of discreet pieces of material allowing removal of only part of the content in the packaging container.

By a "pulverulent material" as used herein is implied any material in the form of particles, granules, grinds, plant fragments, short fibres, flakes, etc.

By a partly or fully removable transport closure is meant a member that may be fully or partly removed by a user in order to provide initial access to an interior compartment of the packaging container either by breaking a seal between the transport closure and the inner surface of the container wall, or by tearing or otherwise breaking the transport closure itself. Tearable transport closures may be provided with one or more predefined weakenings, such as perforations or a cut partly through the members.

A partly or fully removable transport closure may be gastight or gas-permeable. A gastight member may be manufactured from any material or material combination suitable for providing a gastight sealing of a compartment delimited by the transport closure, such as aluminium foil, silicon-coated paper, plastic film, or laminates thereof. A gastight member is advantageous when the bulk solids stored in the packaging container are sensitive to air and/or moisture, and it is desirable to avoid contact of the packaged bulk solids with ambient air. According to the present disclosure a gastight transport closure is preferred as the purpose is to produce and maintained a controlled pressure above the ambient pressure within the packaging container.

In the assembled and filled packaging container which is disclosed herein, the peelable or openable transport closure forms a cross-sectional seal between an inner compartment in the container body and the container opening. The inner peelable or openable transport closure is a transport and storage seal which is eventually broken or removed by an end user of the packaging container.

A packaging container may be considered to be gastight if it provides an oxygen barrier of approximately 0.006 cc oxygen/24 h or less at 23° C. and 50% relative humidity.

BRIEF DESCRIPTION OF THE DRAWINGS

The present invention will be further explained hereinafter by means of non-limiting examples and with reference to the appended drawings wherein.

DETAILED DESCRIPTION

It is to be understood that the drawings are schematic and that individual components, such as layers of materials are not necessarily drawn to scale. The packaging containers shown in the figures are provided as examples only and should not be considered limiting to the invention. Accordingly, the scope of invention is determined solely by the scope of the appended claims.

Figure 1:
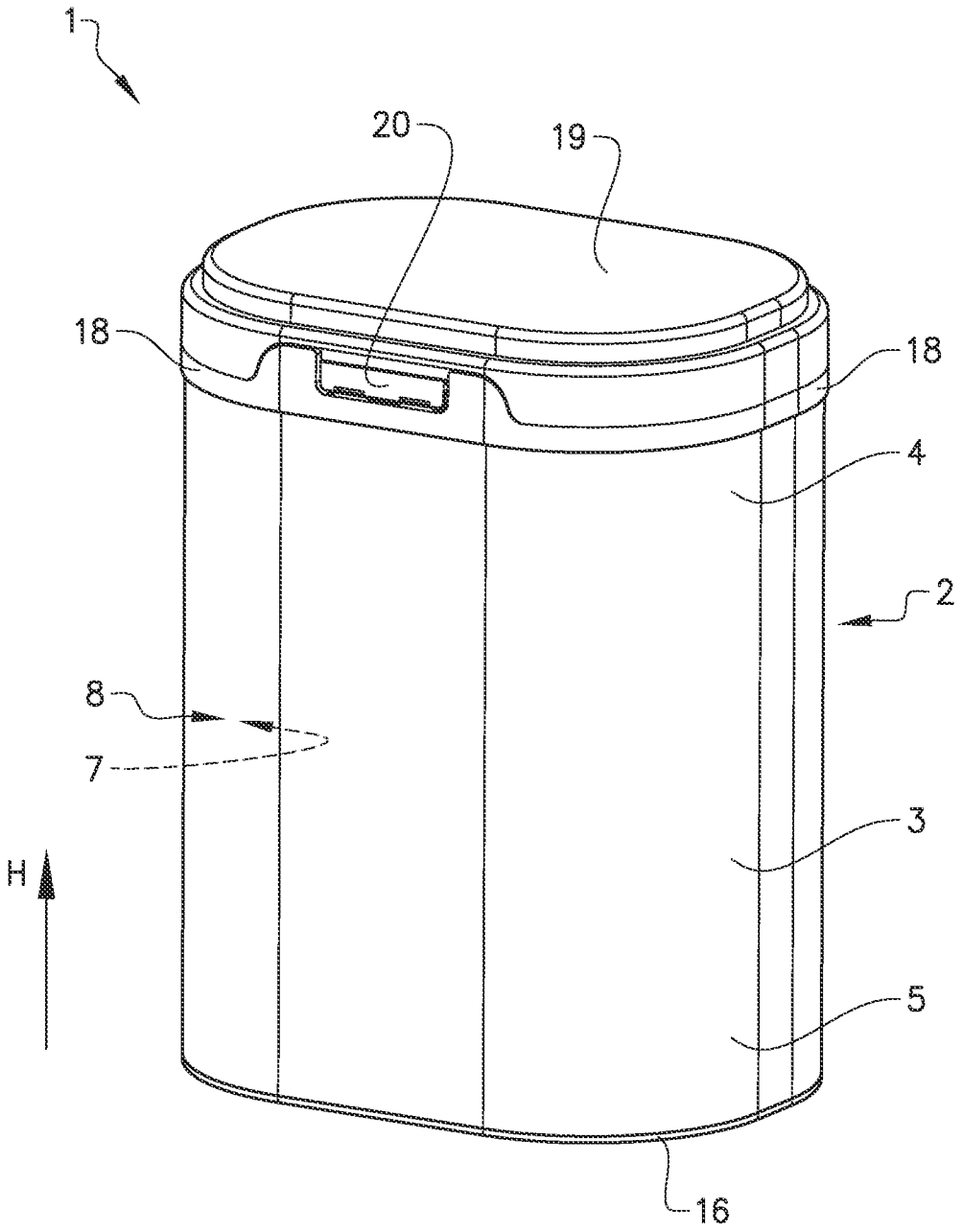
FIG. 1 illustrates a packaging container according to the present disclosure.
Figure 2:
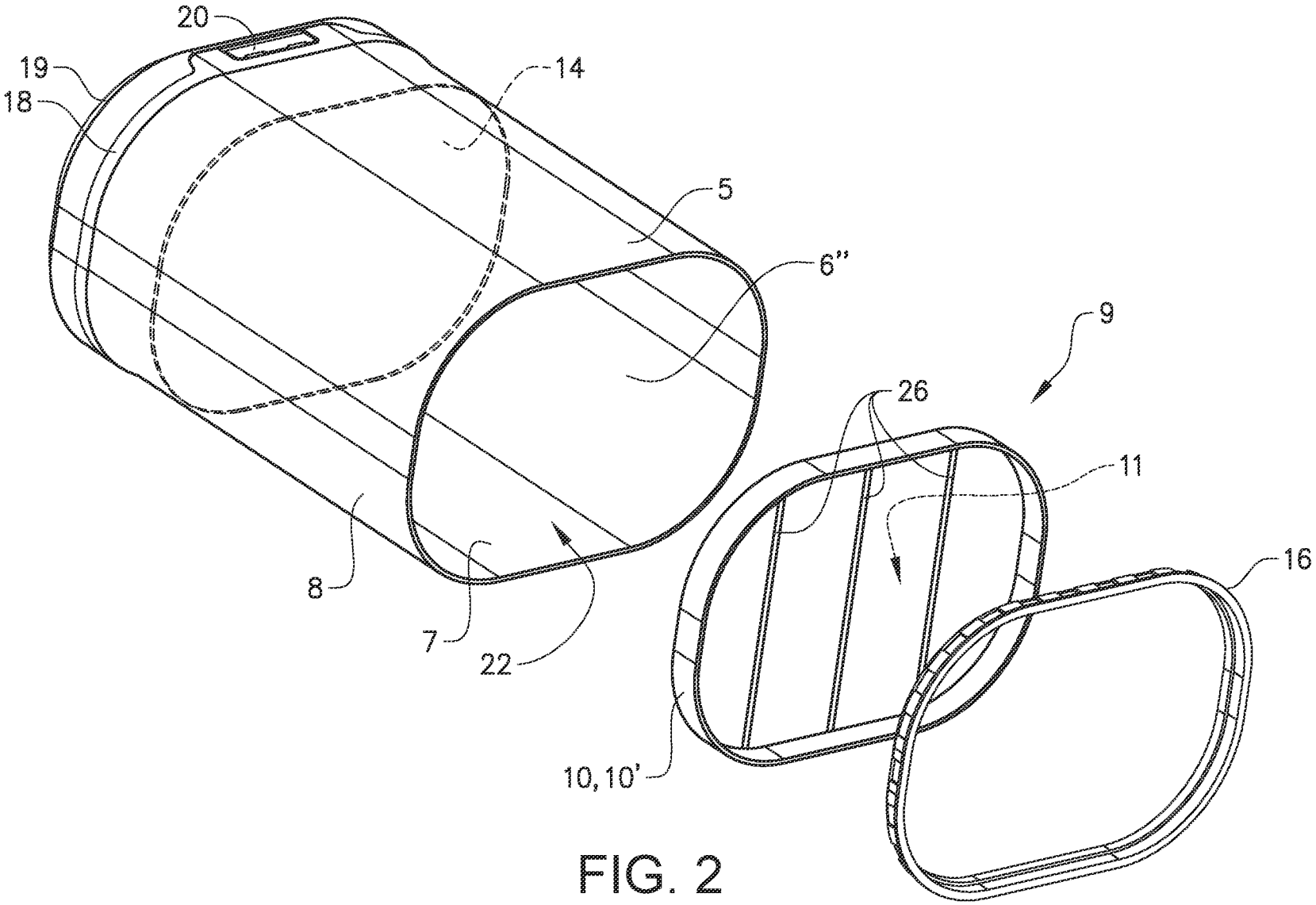
FIG. 2 shows an exploded view of the packaging container according to the present disclosure.

FIGS. 1 and 2 illustrate a paperboard packaging container 1 for bulk solids according to the present disclosure. The particular shape of the container 1 shown in the figures should not be considered limiting to the invention. Accordingly, a packaging container produced according to the invention may have any useful shape or size.

The packaging container 1 comprises a container body 2 having a container body wall 3 extending in a height direction of the container between an upper end 4 with an upper body opening 6' and a bottom end 5 with a bottom body opening 6". The container body wall 3 has an inner surface 7 facing towards an inner compartment 22 in the packaging container 1 and an outer surface 8 facing away from the inner compartment 22. The container body 2 is made from paperboard material as defined herein.

Figure 3:
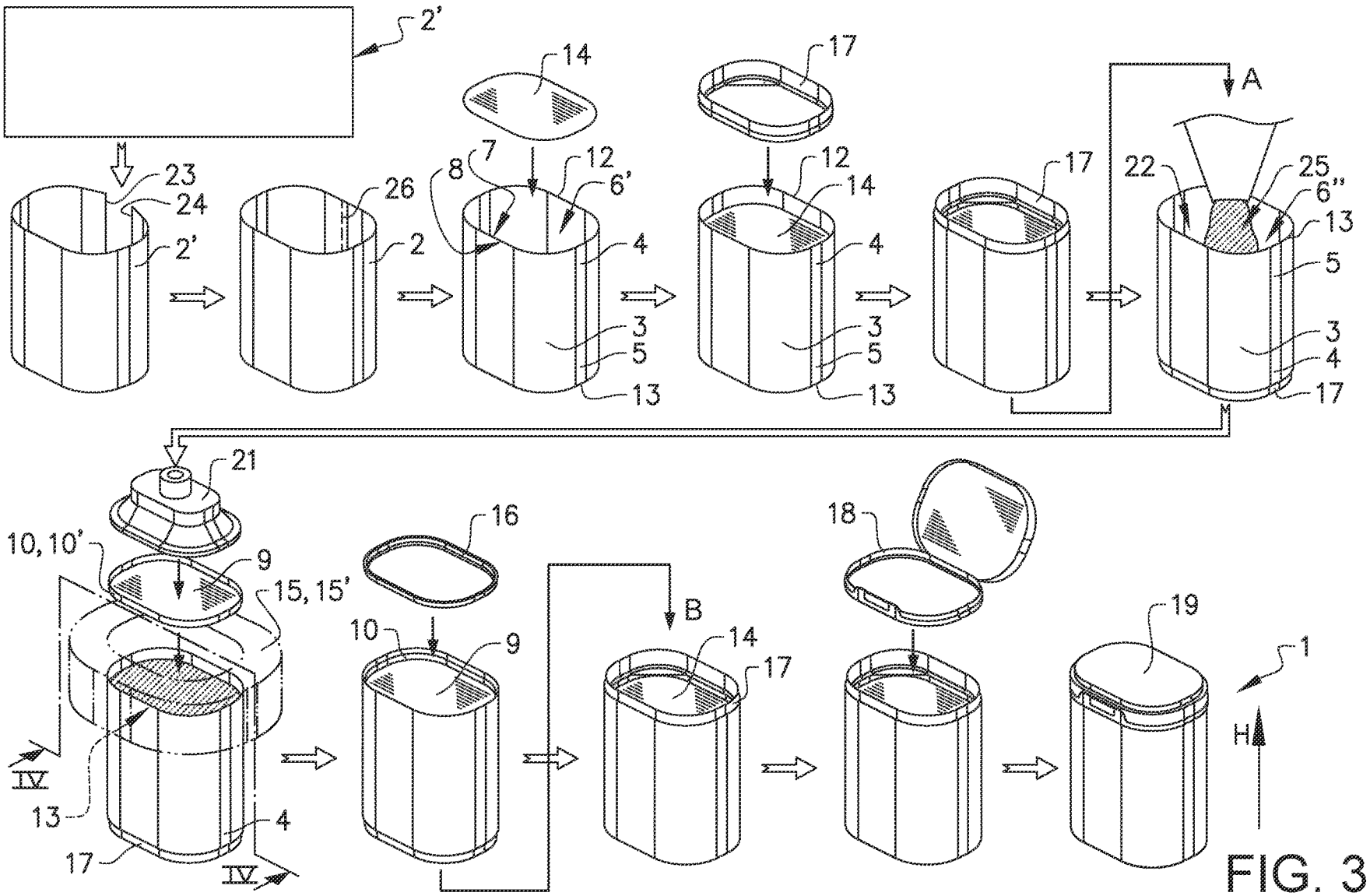
FIG. 3 shows schematically a process for producing and filling the packaging container in FIG. 1.

The packaging container 1 furthermore comprises an inner partly or fully removable transport closure 14 forming a cross-sectional seal between the inner compartment 22 in the container body 2 and the upper body opening 6', as shown in FIG. 2. The packaging container 1 also comprises a closure arrangement comprising a container lid 19 and a bottom disc 9 sealing the bottom body opening 6". As shown in FIG. 2, the bottom disc 9 comprises a bottom disc outer edge portion 10 surrounding a bottom disc base portion 11. The outer edge portion 10 may be flexed and shaped during insertion and projects out of a main plane of the bottom disc 9 to form a flange 10' aligned with the inner surface 7 of said container wall 3. However, the bottom disc 9 may also, as shown in FIG. 3, be pre-formed, such that the outer edge portion 10 already is flexed and shaped to a peripheral flange 10' projecting out of a main plain of the bottom disc before being pressed into the bottom body opening 6" at the bottom end 5. The bottom disc 9 comprises reinforcing elements 26 in the form of continuous embossed lines.

The flange 10' is subsequently sealed against the inner surface 7. The bottom disc 9 is attached by welding, such as by high frequency welding, to the inner surface 7 of the container body wall 3 to ensure a tight seal between the flange 10' and the inner surface 7. While the bottom disc may be made from any suitable material such as paperboard, plastic or metal, paperboard bottom discs may generally be preferred.

As shown in FIG. 2, the packaging container 1 may furthermore be provided with a bottom reinforcement rim 16. The bottom reinforcement rim 16 may be joined to the inner surface 7 of the container body wall 3 by welding such that a more reliably sift-proof joint between the rim 16 and the container wall 3 can be achieved, than with an adhesive seal.

The packaging container may furthermore, for reinforcement, be provided with an upper reinforcing rim 17 to the upper body opening 6' and a frame structure 18, which may be mechanically connected with the upper reinforcing rim 17. The frame structure 18 may then serve to provide features such as a lid hinge. The frame structure 18 is in FIGS. 1 and 2 provided with locking elements 20 for retaining the lid 19 in a closed position over the access opening.

The application of a bottom reinforcing rim 16 to the bottom end of the packaging container, an upper reinforcing rim 17 to the upper body opening 6' and a frame structure 18 is optional for the packaging container disclosed herein.

A packaging container as shown in FIGS. 1 and 2 may be produced and filled by the method illustrated in FIG. 3. The method involves forming a tubular container body 2 from a paperboard sheet 2' by bringing together the side edges 23,24 of the paperboard sheet 2', thus causing the material to assume a tubular shape. The side edges 23,24 of the paperboard sheet 2' are then sealed together. Sealing of the side edges may be made by any suitable method as known in the art, such as by welding or gluing, with welding being preferred. In the process shown in FIG. 3, the side edges 23,24 of the container body sheet 2' are sealed using a sealing strip 26. The use of a sealing strip 26 is optional to the invention.

The container body 2 has an upper end 4 with an upper body opening 6' and a bottom end 5 with a bottom body opening 6" and a container wall 3 extending between the upper end 4 and the bottom end 5. The container wall has an inner surface 7, an outer surface 8, an upper end edge 12 and a bottom end edge 13.

The upper body opening 6' is closed by applying a transport closure 14 across the opening 6' and attaching a peripheral edge portion of the transport closure 14 to the inner surface 7 of the container wall 3 at a distance from the upper end edge 12 of the container wall 3. The transport closure 14 is preferably attached by being welded to the inner surface 7 of the container wall 3. The weld seal may be a peelable seal or a permanent seal. If the weld seal is a permanent seal, the transport closure 14 is preferably provided with means to allow it to be torn open by a user. Such tearing means may be perforations or other tear indications as disclosed herein.

An upper reinforcing rim 17 in the form of a closed loop with a main extension in a loop plane may subsequently be provided. The upper reinforcing rim 17 has an upper rim part and a bottom rim part in the height direction of the upper reinforcing rim 17 and is applied to the container body by inserting the lower rim part into the upper body opening 6' of the container body 2. However, also the upper part of the upper reinforcing rim 17 may be inserted into the container body 2.

Accordingly, the upper reinforcing rim 17 may be inserted into the container body 2 such that an upper end edge of the upper reinforcing rim 17 remains outside of the container body 2 or is flush with the upper end edge 12 of the container wall 3.

By inserting the upper reinforcing rim 17 which is more rigid than the container body 2 into the container body, the upper end edge 12 of the container body 2 is brought to conform to the outer contour of the upper reinforcing rim 17. Accordingly, the application of the upper reinforcing rim 17 to the container body wall 3 serves to bring the upper end edge 12 and thereby also the container wall 3 to assume a cross-sectional shape following the contour of the upper reinforcing rim 17. Additionally, as the packaging container 1 is turned and filled upside-down the upper reinforcement rim 17 provide support for the upper end edge 12 during filling of the inner compartment 22.

A weld seal may thereafter be formed between the inner surface 7 of the container body wall 3 and the inserted lower part of the upper reinforcing rim 17. As described herein, the weld seal is preferably a high frequency weld seal and is formed by applying heat and pressure perpendicular to the container body wall 3 to melt and locally soften thermoplastic components in the upper reinforcing rim 17 and/or on the inner surface 7 of the container body wall 3.

The partly assembled packaging container is then turned upside-down as indicated by the arrow A until the bottom body opening 6" and the bottom end 5 of the container body 2 comes to be directed upward and is introduced into a filling station where bulk solids is filled into the container body 2 through the upwardly directed bottom body opening 6".

It should be understood that the upper reinforcing rim 17 may alternatively be attached while the packaging container 1 is in the upside-down position shown after the arrow A. In such case, the packaging container 1 already has the correct orientation when presented to the filling station and no turning step is carried out. It is to be understood, that the container body 2 may be held in any suitable position during process steps a) of forming a tubular container body 2 and, b) attaching an inner transport closure 14, as long as it is presented to the filling station with the bottom opening directed upwardly as shown after the arrow A in FIG. 3. It should furthermore be understood that the upper reinforcing rim 17 is optional for the packaging container 1, and the packaging container 1 may also not comprise an upper reinforcement rim at all.

Subsequently, the bottom body opening 6" is closed at a bottom body opening sealing station comprising a closed guiding channel 15' formed by a guiding member 15 enclosing the circumference of the container body and forming an channel extending in an upwards direction from the bottom end edge 13. The bottom body opening 6" is closed by pressing the bottom disc 9 through the guiding channel 15' and into the bottom body opening 6" by means of a pressing foot 21. By pressing the bottom disc 9 through the guiding channel 15' a pre-set and thus controlled pressure above the ambient pressure is produced within the inner compartment 22 of the packaging container 1. The surface area of the bottom disc 9 has a size ratio of at least 1.01 to the surface area of the body bottom opening 6". The bottom disc may either be shaped before insertion into the bottom body opening 6" by bending the outer edge portion(s) 10 of the bottom disc 9 to create a flange 10' that can be welded to the inner surface 7 of the container body wall 3, or alternatively the outer edge portion(s) 10 is shaped and flexed when the bottom disc 9 is pressed into the guiding channel 15', such that the outer edge portion(s) forms a flange 10' projecting out of a main plane of the bottom disc 9 that can be welded to the inner surface 7 of the container body wall 3.

The guiding channel 15' extends away from said container body 2, in the height direction (H), with a length ($L_1$), as measured from said bottom end edge (13). The bottom disc (9) is pressed into the bottom body opening 6" with a length $L_2$ in the height direction, as measured between the bottom end edge 13 and the bottom disc base portion 11, at the peripheral edge of the base portion 11. The sum of $L_1$ and $L_2$ is at least 25 mm.

The bottom disc 9 is pressed by means of the pressing foot 21 with a speed of at least 30 mm/s and not more than 150 mm/s.

The guiding channel 15' is a combined welding means 27 and guiding channel 15' comprising a first welding means for performing the step of attaching the bottom disc 9 to the inner surface 7 of the container body 2 by welding.

While the bottom disc may be made from any suitable material such as paperboard, plastic or metal, paperboard bottom discs may generally be preferred. The bottom disc preferably comprises a material having a stiffness of from 100 mN to 1500 mN. When the bottom disc comprises relatively stiff material, the bottom disc preferably comprises folding lines corresponding to the size and shape of the body bottom opening to enable prefolding of the outer edge portions 10 or folding of the outer edge portions 10 when the bottom disc 9 is pressed into the bottom body opening 6". The bottom disc 9 is attached by welding, such as by high frequency welding, to the inner surface 7 of the container body wall 3 immediately after the step of closing the body bottom opening 6" with the bottom disc 9.

After the bottom disc 9 has been applied over the bottom body opening 6", a bottom reinforcing rim 16 may be attached to the inner wall 7 of the container body 2 at the bottom end 13 of the container body 2.

The application of a bottom reinforcing rim 16 to the bottom end of the packaging container is optional to the process as disclosed herein.

The partly assembled packaging container is then turned again as indicated by the arrow B until the upper end 4 of the container body 2 comes to be directed upward whereafter a lid component including a container lid 19 and a frame structure 18 is snapped onto the upper reinforcing rim 17 to produce the fully assembled and filled packaging container 1.

It is to be understood that the upper body opening 6' may alternatively be closed with the transport closure 14 after the upper reinforcing rim 17 has been applied to the container body 2. A further alternative is to apply the transport closure 14 from the bottom end 13 of the container body 2 which is preferably done after the container body has been turned upside-down as indicated by the arrow B in FIG. 3. Accordingly, the transport closure 14 can be applied at any suitable point in the process, as long as it is applied before the filling step, as the sealing membrane 14 is needed to keep the bulk solids in the container body 2 during the filling step.

It is also to be understood that it is optional to the process as disclosed herein to apply a frame structure/lid component to the upper reinforcing rim 17. Accordingly, the filled and bottom-sealed packaging container may alternatively be provided with a lid which is directly applied to the upper reinforcing rim 17, either as a completely removable lid or as a lid which is attached to the upper reinforcing rim 15 by means of a two-part hinge. The container lid may also be an integrated lid comprising a plug-in portion, as disclosed in EP 0 611 703 B1.

It is an advantage of a lid construction as shown in the figures that a frame structure 18 or a whole lid component can be attached to the upper reinforcing rim 17 after the container 1 has been filled and closed around the contents 25. In this manner, the risk that the lid component or frame structure 18 is damaged in the production and filling process is minimized. Furthermore, by attaching a three-dimensionally shaped lid component or frame structure 18 at a late stage in the process, the packaging container 1 can be filled from the bottom end of the container body 2, which means that the transport closure 14 can be applied in the packaging container before the container is filled. An advantage with applying the transport closure 14 in the packaging container before the packaging container is filled with bulk solids 25 is that there is no risk that the seal between the membrane and the container wall is contaminated by the bulk solids.

Furthermore, there is no risk that any of the packaged bulk solids will end up outside the transport closure 14, in the space between the lid and the transport closure, which may happen if the transport closure is applied after filling of the packaging container. A user opening a new packaging container for a first time and finding some of the contents outside the sealing membrane would consider the container to be less hygienic and reliable than a container in which the space between the transport closure and the lid is completely clean.

Figure 4:
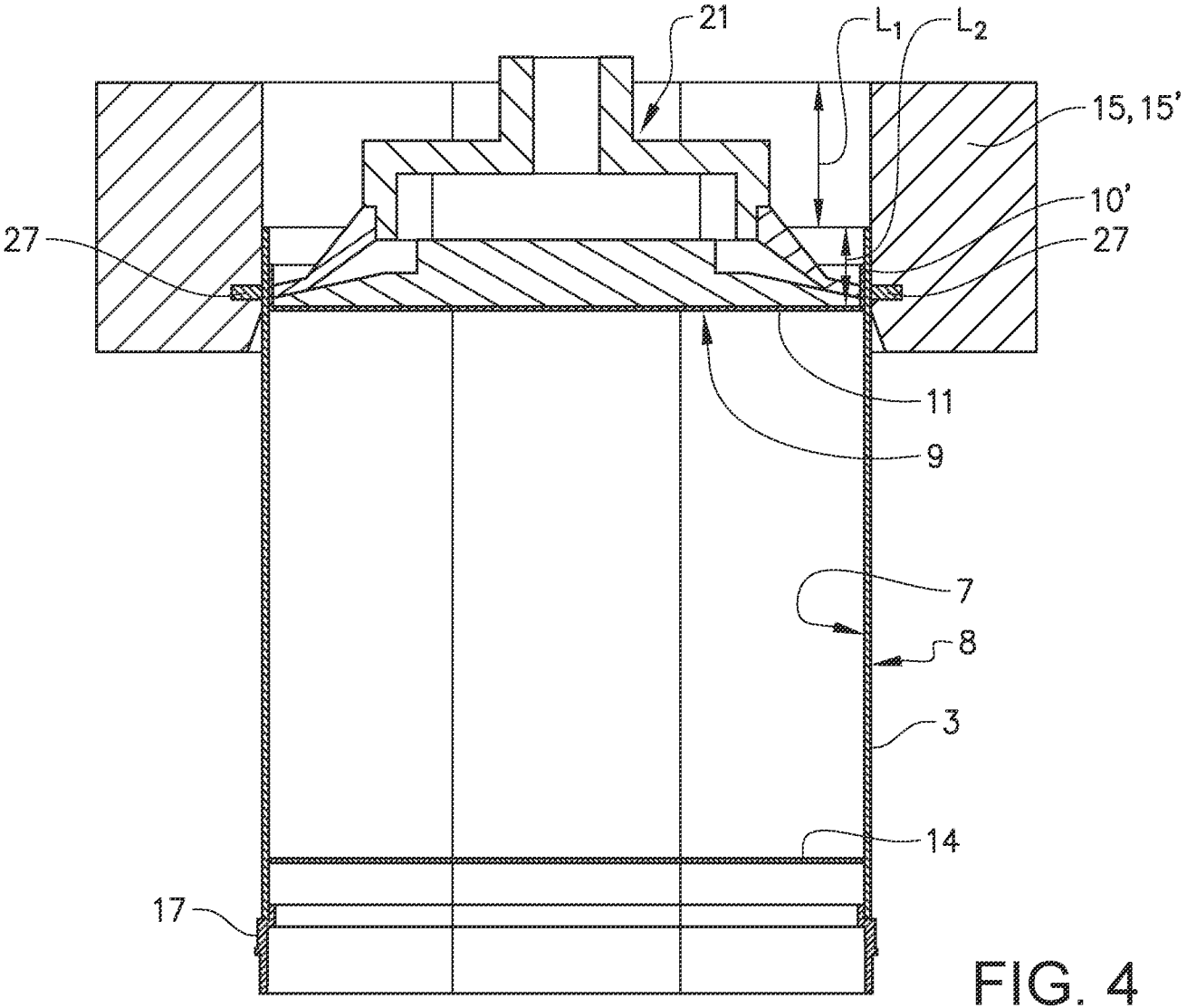
FIG. 4 shows a cross-section taken along the line IV-IV in FIG. 3.

With reference to FIG. 4, there is shown a cross section of the bottom body opening sealing station taken along the line IV-IV in FIG. 3. FIG. 4 illustrates the bottom body opening sealing station wherein the pressing foot has pressed the bottom disc 9 through the guiding channel 15' and into the bottom body opening 6" such that a slight pressure above the ambient pressure is produced. The guiding channel 15' extends with a length L1 of 8 cm in a height direction from the bottom end edge 13 of the container body 2. The guiding channel 15' is provided with a welding means 27 for providing a welding seam.

The invention claimed is:

1. A method of producing and filling a paperboard packaging container with bulk solids comprising:

a) forming a tubular container body from a paperboard sheet, said container body having an upper end with an upper body opening and a bottom end with a bottom body opening and a container body wall extending in a height direction (H) of said packaging container between said upper body opening and said bottom body opening, said container body wall having an inner surface and an outer surface, an upper end edge and an bottom end edge;

b) attaching an inner partly or fully removable transport closure to said inner surface of said container body wall and/or sealing said upper body opening with a container lid;

c) presenting said container body to a filling station with said bottom body opening of said container body directed upward in a vertical direction;

d) filling bulk solids into said container body through said upwardly directed bottom body opening;

e) presenting said container body to a bottom body opening sealing station comprising at least one guiding member forming an, as seen from the bottom end, upwardly extending guiding channel, f) closing said bottom body opening by pressing a bottom disc through said guiding channel and into said bottom body opening, wherein an internal gas pressure above ambient pressure is produced within said packaging container, wherein the bottom disc has a peripheral flange surrounding a bottom disc base portion, wherein said peripheral flange is flexed towards the lower end in said height direction (H), wherein said guiding channel extends away from said container body, in said height direction (H), with a length ($L_1$), as measured from said bottom end edge, wherein said bottom disc is pressed into said bottom body opening with a length ($L_2$) in said height direction, as measured between said bottom end edge and said bottom disc base portion, wherein the sum of $L_1$ and $L_2$ is at least 25 mm;

g) attaching said flange to said inner surface of said container body wall by welding, wherein step g) is performed immediately after step f) while maintaining the internal gas pressure above the ambient pressure; and h) turning said container body, wherein said upper end is directed upwards in the vertical direction and said bottom end is directed downwards in the vertical direction, wherein the bottom disc is subjected to a combined influence of (A) the internal gas pressure and (B) bulk solids compressing against the bottom disc under gravity.

2. The method according to claim 1, wherein the sum of $L_1$ and $L_2$ is between 25 mm and 260 mm.

3. The method according to claim 2, wherein $L_2$ is at least 5 mm.

4. The method according to claim 1, wherein $L_2$ is at least 5 mm.

5. The method according to claim 1, wherein $L_1$ is at least 20 mm.

6. The method according to claim 1, wherein said guiding member encloses 80% or more of a perimeter of said container body.

7. The method according to claim 6, wherein said guiding member encloses 95% or more of the perimeter of said container body.

8. The method according to claim 1, wherein said guiding member is in the form of a closed guiding channel, enclosing a perimeter of said container body entirely.

9. The method according to claim 1, wherein a size ratio of a surface area of the bottom disc to a surface area of the bottom body opening is at least 1.01, wherein an outer edge portion of said bottom disc is shaped and flexed when said bottom disc is pressed into said body bottom opening, wherein said outer edge portion of said bottom disc forms a flange projecting out of a main plane of said bottom disc, wherein said flange is aligned with said inner surface of said container body wall.

10. The method according to claim 9, wherein said size ratio of said bottom disc surface area to said bottom body opening surface area is from 1.01 to 1.3.

11. The method according to claim 1, wherein said bottom disc is pressed into said bottom body opening with a speed from 30 mm/s to 150 mm/s.

12. The method according to claim 1, wherein said bottom disc comprises reinforcing elements.

13. The method according to claim 12, wherein said reinforcing elements comprises embossed continuous or discontinuous lines.

14. The method according to claim 1, wherein said bulk solids is a pulverulent material.

* * * * *